United States Patent [19]

Cuniberti

[11] Patent Number: 4,735,455

[45] Date of Patent: Apr. 5, 1988

[54] CONVERTIBLE PIECE OF FURNITURE

[76] Inventor: Ferdinando Cuniberti, Via Dante 22, I-25014 Castenedolo, Italy

[21] Appl. No.: 925,705

[22] Filed: Oct. 30, 1986

[51] Int. Cl.[4] ..... A47C 13/00

[52] U.S. Cl. ..... 297/1; 297/36

[58] Field of Search ..... 297/1, 2, 3, 92, 104, 297/93, 94, 325, 36

[56] References Cited

U.S. PATENT DOCUMENTS

| | | | |
|---|---|---|---|
| 76,202 | 3/1868 | Knell | 297/1 |
| 157,042 | 11/1874 | Vass | 297/1 |
| 604,156 | 5/1898 | Karrer | 297/36 |
| 728,209 | 5/1903 | Dawson | 297/94 X |
| 2,494,045 | 1/1950 | Kauffman | 297/1 X |
| 2,563,553 | 8/1951 | Rosenjack | 297/36 |
| 2,952,302 | 9/1960 | Mittlieder | 297/93 X |
| 3,188,662 | 6/1965 | Watson | 297/1 X |
| 4,164,356 | 8/1979 | Knight | 297/1 |
| 4,244,619 | 1/1981 | Yoshimura | 297/36 X |
| 4,580,834 | 4/1986 | De La Sota Martinez | 297/3 X |

FOREIGN PATENT DOCUMENTS

| | | | |
|---|---|---|---|
| 2041436 | 1/1977 | Fed. Rep. of Germany | 297/1 |
| 766460 | 6/1934 | France | 297/36 |
| 1047937 | 12/1953 | France | 297/93 |
| 1091524 | 4/1955 | France | 297/1 |
| 5477 | of 1904 | United Kingdom | 297/94 |

*Primary Examiner*—Kenneth J. Dorner

*Assistant Examiner*—José V. Chen

*Attorney, Agent, or Firm*—Peter K. Kontler

[57] ABSTRACT

A convertible piece of furniture wherein a back support is connected to two frame members which are pivotable relative thereto through approximately 180° about parallel axes which are inclined relative to the plane of the support for the piece of furniture between first positions in which the frame members and the back support constitute or form part of an upright chair with the back support disposed at a first angle to the plane of the support, and second positions in which the back support and the frame members constitute or form parts of an easy chair with the back support disposed at a different second angle with reference to the surface of the support. The frame members can include portions which constitute a seat in front of the back support in the first positions of the frame members but constitute two discrete arm rests in the second positions of the frame members. Alternatively, one of the frame members can carry a seat which is pivotable relative to the one frame member about an axis which is parallel to or extends at right angles to the front side of the back support; such frame member is disposed in front of the back support in the first positions and behind the back support in the second positions of the frame members. Still further, a seat which is normally located behind the back support can be pivoted relative thereto to be of use in the second positions of the frame members.

22 Claims, 6 Drawing Sheets

CONVERTIBLE PIECE OF FURNITURE

BACKGROUND OF THE INVENTION

The present invention relates to improvements in convertible pieces of furniture, especially to pieces of furniture which can be converted into upright (plain) chairs or into easy (lounge) chairs.

It is customary to place plain or upright chairs and easy or lounge chairs around a swimming pool, around a table on a veranda or terrace, in the sun room of a house, in a garden or elsewhere. Such pieces of furniture occupy a substantial amount of space, not only at the locale of use but also in storage. Furthermore, it is often sufficient to set up a certain number of upright chairs alone or a certain number of easy chairs alone, not only to save space but also to reduce the cost of garden, poolside, terrace, veranda or other furniture by halving the total number of chairs. Still further, the space on a terrace or elsewhere may not suffice to set up a substantial number of chairs.

On the other hand, applicant has discovered that different types of chairs do, or can, have numerous parts which are similar to or identical with each other, not only as concerns their appearance but also as concerns their sizes. An important difference is that the parts in a simple or upright chair are oriented or distributed differently than the corresponding parts of an easy chair.

OBJECTS AND SUMMARY OF THE INVENTION

An object of the invention is to provide a piece of furniture which is simple, compact and relatively inexpensive and which can be converted into a first type of seating facility or into a second type of seating facility with the exertion of a small force and in a time-saving manner.

Another object of the invention is to provide a seating facility which can be converted into an upright chair or into an easy chair by children, adolescents or adults.

A further object of the invention is to provide a novel an improved method of converting an easy chair into a different type of seating facility or vice versa.

An additional object of the invention is to provide a piece of furniture which occupies little room in storage and which can be assembled from simple, rugged and inexpensive parts.

Still another object of the invention is to provide a novel and improved easy chair or lounge chair which can be converted into a different seating facility.

Another object of the invention is to provide a novel and improved upright chair which can be converted into a different seating facility.

Still another object of the invention is to provide a piece of furniture which can be caused to accurately or closely conform to the outlines of the adjacent portion of the body of an occupant irrespective of whether the piece of furniture is caused to serve as a first seating facility or a different second seating facility.

A further object of the invention is to provide novel and improved seats and novel and improved arm rests for use in the seating facilities of the above outlined character.

The invention is embodied in a convertible piece of furniture for use as a first seating facility or as a different second seating facility, particularly for use as an upright (simple, plain or card) chair or as an easy chair or lounge chair. The improved piece of furniture comprises a frame including first and second lateral frame members which are arranged to rest on a predetermined surface (e.g., on the horizontal surface of a floor), a back support which is disposed between the frame members and has first and second lateral portions, and hinges which serve to articulately connect the frame members to the respective lateral portions of the back support for movement with reference to the back support through angles in excess of 90° (preferably approximately or exactly 180°) between first positions in which the piece of furniture constitutes the first seating facility and second positions in which the piece of furniture constitutes the second seating facility. The mounting of the back support on the frame is preferably such that the back support makes with the predetermined plane a first angle when the piece of furniture constitutes the first seating facility but a different second angle when the piece of furniture is converted into the second seating facility.

The frame further comprises or carries a seat. For example, the seat can comprise first and second portions which are rigid or integral with the respective (first and second) frame members to constitute a composite seat in the first positions and discrete arm rests in the second positions of the frame members. The axes of the hinges are or can be inclined relative to the surface of the support (i.e., such axes can make with the surface of the support an acute or an obtuse angle). Each frame member can constitute a substantially C-shaped or U-shaped body made of tubular metallic or plastic stock.

In accordance with one presently preferred embodiment of the invention, the frame members can comprise lower portions which contact the surface of the support in each position of the respective frame member and second or upper portions which together constitute a seat in the first positions and discrete arm rests in the second positions of the frame members. The frame can further comprise a third frame member which is rigid with the back support and constitutes a seat in the second positions of the frame members.

Means is provided for releasably coupling the frame members to each other and/or to the back support and/or to other parts of the frame in the first and/or second positions of the frame members.

In accordance with another embodiment of the invention, the frame members can constitute the entire frame of the piece of furniture. Such piece of furniture can comprise a discrete seat and means for pivotally connecting the seat to the back support for movement between an inoperative position behind the back support and an operative position in the second positions of the frame members so that the seat can constitute a part of an easy chair. The seat is or can be substantially horizontal when it assumes the operative position. The connecting means for the seat can define a substantially horizontal pivot axis. The seat is releasably coupled to the back support (in its inoperative position) and to the back support, to one or both frame members and/or to one or more other parts of the frame in its operative position. The coupling means can comprise plate-like members on the frame members and male coupling elements provided on the seat and receivable in or arranged to extend into complementary openings in the plate-like members.

It is also possible to use a seat which is pivotably connected to one of the frame members for movement about a substantially horizontal axis which is parallel to or extends at right angles to the front side of the back support in the first positions of the frame members. Such seat is adjacent the front side of the support when the piece of furniture constitutes a first seating facility and to the rear side of the back support when the piece of furniture constitutes a second seating facility. The seat can constitute a trough in at least one of its positions of use, e.g., when the piece of furniture constitutes an easy chair.

Flexible upholstering means in the form of panels made from a textile or other suitable material are provided on the back support and on the frame to contribute to the comfort of the occupant.

Each frame member can comprise a first portion (e.g., the aforementioned arm rest) in a first plane and a second portion (e.g., the aforementioned lower portion which rests on the surface of the support) in a second plane which extends at right angles to the first plane.

The novel features which are considered as characteristic of the invention are set forth in particular in the appended claims. The improved piece of furniture itself, however, both as to its construction and the mode of manipulating the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
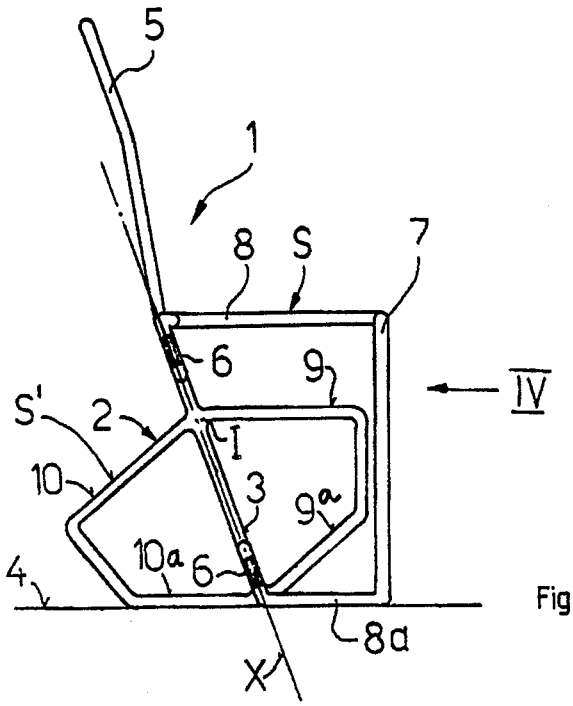
FIG. 1 is a side elevational view of a piece of furniture which can be used as an upright chair or an easy chair, the parts being shown in positions they assume while consitituting an upright chair.
Figure 2:
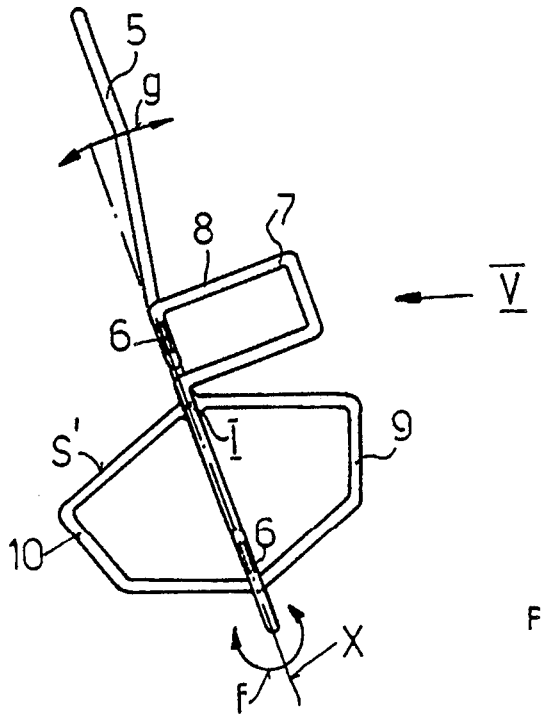
FIG. 2 shows the parts of the piece of furniture of FIG. 1 in positions they assume during conversion of the upright chair into an easy chair.
Figure 3:
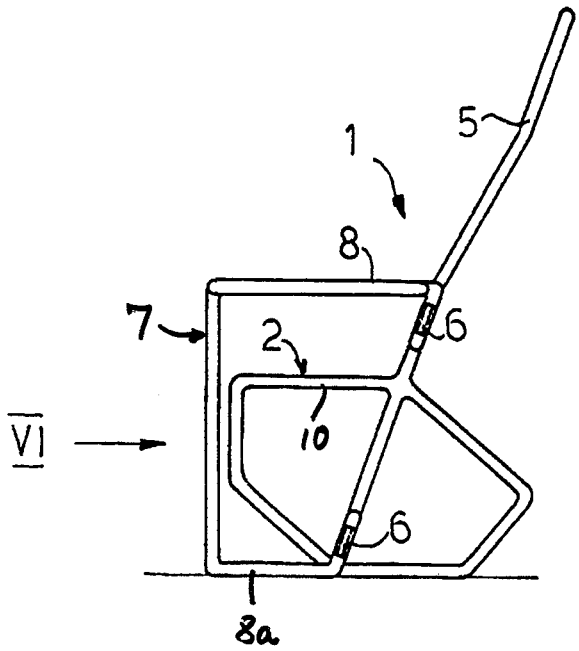
FIG. 3 shows the parts in positions they assume upon completed conversion into an easy chair.

FIGS. 1 to 6 show a first piece of furniture 1 which is a convertible seating facility suitable for use as an upright or plain chair (FIG. 1) or as an easy chair or lounge chair (FIG. 3). The piece of furniture 1 comprises a frame 2 and a back support 5 which latter is inclined with reference to the horizontal surface of the floor 4 or another support for the piece of furniture. The frame 2 includes a pair of identical pivotable lateral frame members 7 (see particularly FIGS. 4, 5 and 6) and a third frame member including a pair of spaced-apart parallel braces 3 which can be said to constitute a downward extension of the back support 5, and two portions 9, 10 which are disposed at opposite sides of the common plane of the braces 3. The portion 10 contacts the floor 4 when the piece of furniture 1 is used as an upright chair (FIG. 1), and the other portion 9 contacts the floor 4 when the parts of the piece of furniture are caused to form an easy chair (FIG. 3). The frame 2 and the components of the back support 5 can be made of tubular metallic or plastic stock or partly of tubular metallic and partly of tubular plastic stock. Other materials (e.g., wood) can be used with equal or similar advantage. The braces 3 define two axes X which are inclined with reference to the surface of the floor 4 and coincide with or are adjacent and parallel to the axes of two pairs of hinges 6 serving to articulately connect the frame members 7 to the respective lateral portions of the back support 5. The latter can comprise two mutually inclined portions (see particularly FIGS. 1, 2 and 3) for convenience of the person occupying the seating facility. Each frame member 7 comprises a first portion or section which is disposed in a plane parallel to the plane of FIG. 1 when the piece of furniture 1 constitutes an upright chair and a second portion 8 which is disposed in a second plane extending at right angles to the plane of FIG. 1. The portions 8 together constitute a seat S of the upright chair of FIG. 1, and the portions 8 constitute two discrete arm rests of the easy chair of FIG. 3. Each of the frame members 7 can be said to resemble a substantially C-shaped or U-shaped body whose stability suffices to maintain the seat S in requisite position when the straight chair is occupied. The lowermost portions **8*a* of the frame members 7 can be said to constitute legs which are in contact with the surface of the floor 4 in each of the two end positions of the respective frame member 7**.

As shown in FIG. 1, the braces 3 are substantially aligned with the lateral portions of the back support 5 and can be said to constitute extensions of such lateral portions. They carry portions of the respective pairs of hinges 6 which enable the frame members 7 to pivot through angles of substantially 180° (i.e., in excess of 90°) between the first positions of FIG. 1 and the second positions of FIG. 3. The frame 2 contacts the floor 4 with the lower part **10*a* of the portion 10 at one side of the common plane of the braces 3, and with the lower portions 8*a* of the frame members 7 at the other side of such plane. The portions 8 are mirror symmetrical with and adjacent each other (see FIG. 4) and together constitute the seat S of the upright chair. The reference character 11 denotes a simple coupling device (e.g., one or more hooks and eyelets) which releasably holds the portions 8 in the positions of FIGS. 1 and 4 to thus ensure that the seat S which is formed by the portions 8** can be safely occupied by a child, an adolescent or a grown person.

Figure 4:
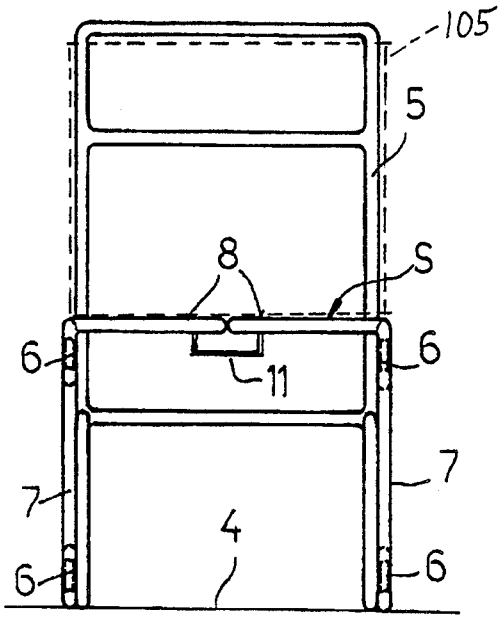
FIG. 4 is a front elevational view of the chair as seen in the direction of arrow IV in FIG. 1.
Figure 5:
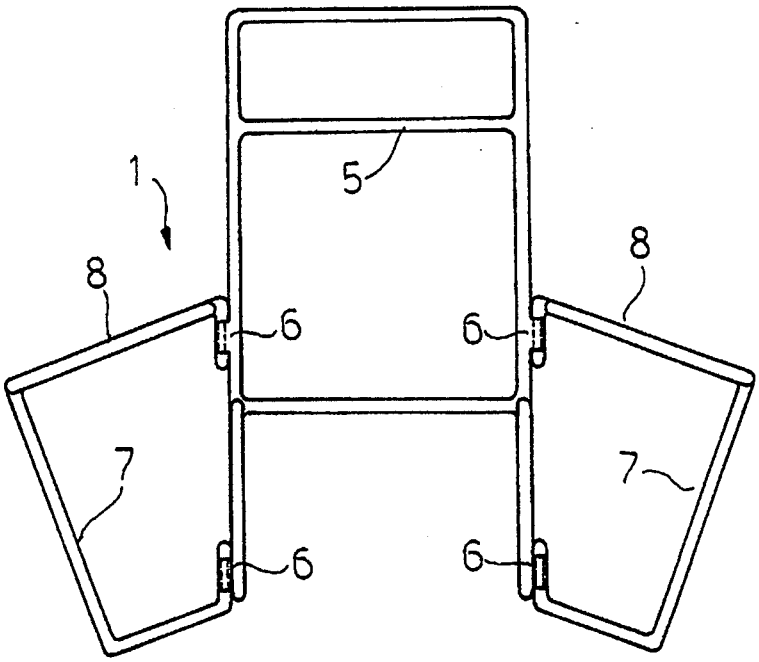
FIG. 5 is a front elevational view as seen in the direction of arrow V in FIG. 2.
Figure 6:
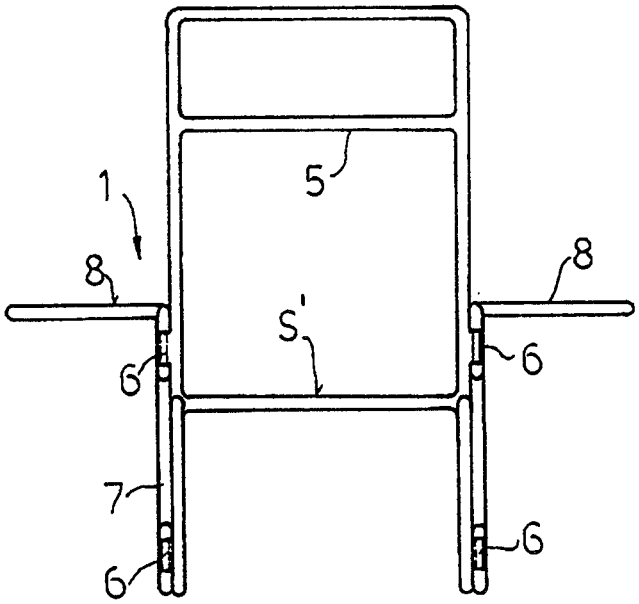
FIG. 6 is a front elevational view of the easy chair as seen in the direction of arrow VI in FIG. 3.

In order to convert the structure of FIGS. 1 and 4 into an easy chair, the person in charge disengages the separable parts of the coupling device 11 so that the frame members 7 can be pivoted about the respective axes X through the intermediate positions of FIGS. 2 and 5 all the way to the positions which are shown in FIGS. 3 and 6. The directions in which the frame members 7 are pivotable about the respective axes X are indicated in FIG. 2 by a double-headed arrow f. At the same time, the additional frame member including the portions 9 and 10 (together with the back support 5) is pivoted about a horizontal axis I (one location of such axis is shown in FIG. 2). This changes the inclination of the back support 5 relative to the surface of the floor 4 and results in a lifting of the portion 10 above the floor simultaneously with a lowering of the part 9*a* of portion 9 into contact with the floor (compare FIGS. 1 and 3). The position of the axis I can be shifted within a reasonably wide range without departing from the spirit of the invention. The arrow g (shown in FIG. 2) denotes the directions in which the back support 5 can be pivoted about the axis I to assume the position of FIG. 1 or FIG. 3. When the parts of the improved piece of furniture 1 reach the positions of FIG. 3, the inclination of the back support 5 is more pronounced than in FIG. 1 and the seat S' of the easy chair is formed by the upper part of portion 10 of the frame 2. In fact, the strongly inclined back support 5 then defines a portion of the seat S' so that a person occupying the easy chair of FIG. 3 can lean backwards and place her or his arms onto the respective arm rests 8. The arm rests 8 are then located in or close to a horizontal plane.

It goes without saying that the improved piece of furniture 1 further comprises suitable panels of textile or other material so as to contribute to comfort of the occupant. A panel 105 of, for example, textile material is shown in FIG. 4 by broken lines. Similar panels are provided on the portion 10 which constitutes or forms part of the seat S' as well as on the portions 8 which constitute the arm rests (FIG. 3) or the seat S (FIG. 1). The panels of the improved piece of furniture 1 can be made of any one of a wide variety of textile materials, cords, sheets made from suitable synthetic plastic material or relatively stiff boards.

A comparison of FIGS. 3 and 4 will reveal that the seat S (composed of the portions 8 of frame members 7) is disposed at a level which is more distant from the floor than the level of the portion 10 which forms the seat S' when the improved piece of furniture 1 is used as an easy chair.

FIG. 5 shows the improved piece of furniture in a front elevational view (arrow V) when the frame members 7 reach the intermediate positions of FIG. 2. The portions 8 are then inclined with reference to a horizontal plane, and the major portions of the frame members 7 are disposed in the common plane of the braces 3. FIG. 6 shows the piece of furniture 1 in a front elevational view (arrow VI in FIG. 3) when the conversion of the chair of FIG. 1 into the easy chair of FIG. 3 is completed. It will be noted that the portions 8 extend outwardly and away from each other when they constitute arm rests, and that such portions 8 extend toward each other when they constitute the seat S.

Figure 7:
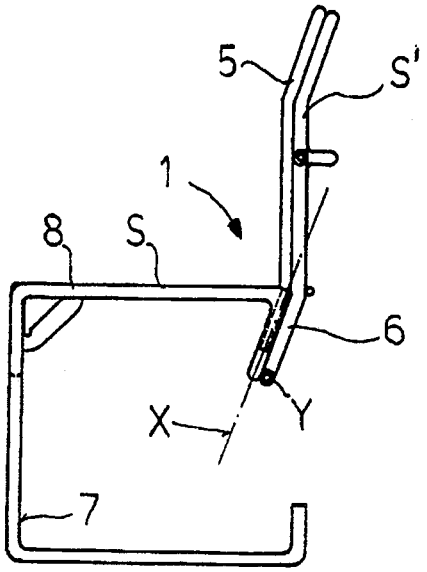
FIG. 7 is a side elevational view of a modified piece of furniture wherein the parts are shown in positions they assume when they constitute an upright chair.
Figure 8:
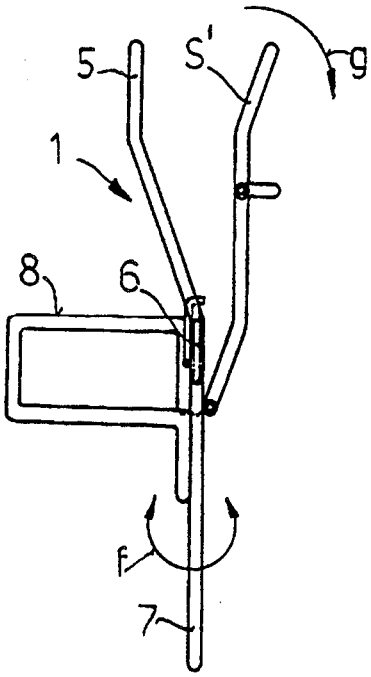
FIG. 8 illustrates the parts of the piece of furniture of FIG. 7 during an intermediate stage of conversion into an easy chair.
Figure 9:
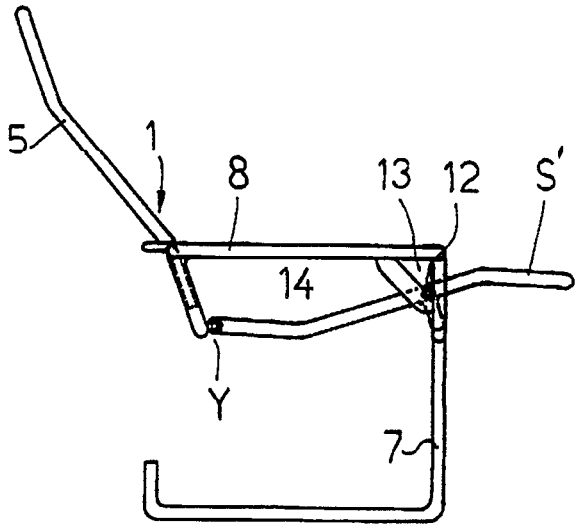
FIG. 9 is a side elevational view of the easy chair which includes the parts of the piece of furniture shown in FIGS. 7 and 8.

FIGS. 7 to 9 show a modified piece of furniture 1 which can constitute an upright chair (FIG. 7) or an easy chair (FIG. 9). The back support 5 of the upright chair shown in FIG. 7 is located in front of a seat S' which is in use when the piece of furniture 1 of FIGS. 7–9 is converted into the easy chair of FIG. 9. The seat S' is then substantially horizontal and its rear end is adjacent the lower end of the back support 5. The means for connecting the seat S' to the back support 5 comprises one or more horizontal hinges which define a horizontal pivot axis Y. It is clear that the seat S' is secured to the rear side of the back support 5 by a suitable coupling device (corresponding, for example, to the coupling device 11 of FIG. 4) when the piece of furniture 1 of FIGS. 7 to 9 is used as an upright chair.

The open C-shaped lateral frame members 7 constitute the frame of the upright chair of FIG. 7 as well as of the easy chair of FIG. 9. The portions 8 of the frame members 7 constitute the seat S of the upright chair or the arm rests of the easy chair. The frame members 7 are pivotable about the respective axes X (defined by the corresponding hinges 6) through angles of approximately or exactly 180°. The means for coupling the frame members 7 to the seat S' when the parts of the piece of furniture 1 of FIGS. 7 to 9 occupy the positions which are shown in FIG. 9 comprise plate-like members 14 which are provided on the frame members 7 and have openings 13 or the like for male coupling elements 12 of the seat S'. Other types of coupling devices can be used just as well, as long as they ensure reliable retention of the seat S' in the position of FIG. 9 and ready separation of the seat S' from the frame members 7 when the easy chair of FIG. 7 is to be reconverted into the upright chair of FIG. 7.

The configuration of the seat S' can match or resemble that of the back support 5 so that these parts can be assembled into and held in the form of a compact package as shown in FIG. 7. The seat S' then stiffens the back support 5.

FIG. 8 shows the frame members 7 and the seat S' in intermediate positions, i.e., during conversion of the upright chair of FIG. 7 into the easy chair of FIG. 9 or vice versa. The seat S' is pivotable in and counter to the direction which is indicated by the arrow g, and the frame members 7 are pivotable in directions which are indicated by the double-headed arrow f.

FIG. 9 shows that the inclination of the back support 5 is more pronounced than in FIG. 7. This contributes to the comfort of the person occupying the easy chair. The portions 8 of the frame members 7 extend outwardly to constitute arm rests.

Figure 10:
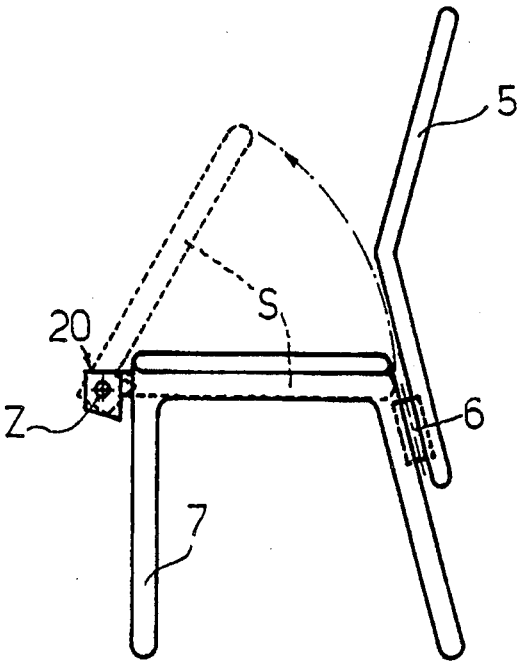
FIG. 10 is a side elevational view of a third piece of furniture whose parts are shown in positions they assume while forming an upright chair, an intermediate position of the seat being indicated by broken lines.

FIG. 10 shows a third piece of furniture wherein the seat S is pivotable about a horizontal axis Z extending in substantial or exact parallelism with the front side of the back support 5. The pivot axis Z is defined by one or more hinges 20 which are mounted in part on one of the frame members 7 and in part of the seat S. When the upright chair of FIG. 10 is to be converted into an easy chair, the seat S is detached from the other frame member 7 (e.g., by disengaging a coupling device of the type shown at 11 in FIG. 4), and the frame members 7 are then pivoted about the axes of the respective hinges 6 through angles of substantially 180° to change the inclination of the back support 5. In the next, step, the seat S is pivoted to a horizontal position at the rear side of the back support 5 and is separably coupled to the other frame member 7 to thus complete the conversion of the upright chair into an easy chair.

Figure 11:
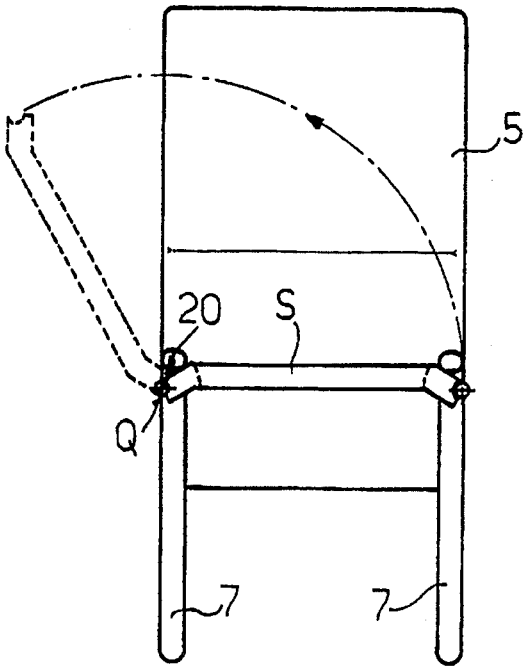
FIG. 11 is a front elevational view of a piece of furniture which constitutes a modification of the piece of furniture of FIG. 10.
Figure 12:
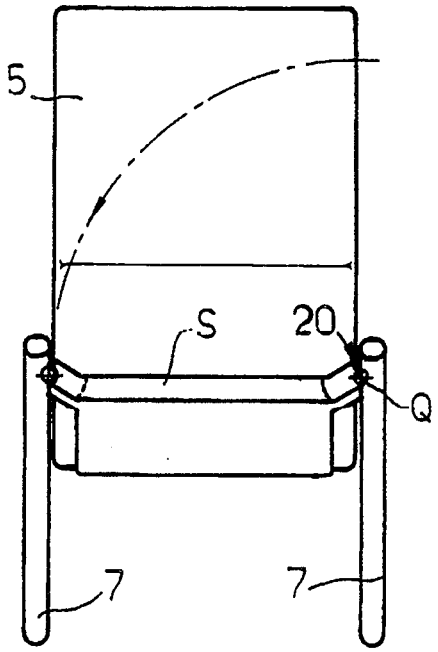
FIG. 12 shows the piece of furniture of FIG. 11 upon conversion into an easy chair.

FIG. 11 shows a piece of furniture which constitutes a modification of the article shown in FIG. 10. The difference is that the horizontal axis Q about which the seat S can be pivoted relative to one of the frame members 7 extends at right angles to the front side of the back support 5. In all other respects, the piece of furniture of FIG. 11 is or can be the same as that of FIG. 10. The right-hand frame member 7 must be disconnected from the seat S (while the latter occupies the solid-line position of FIG. 11) before the seat can be pivoted to the broken-line position simultaneously with or prior or subsequent to pivoting of the frame members 7 through 180° to the other (rear) side of the back support 5. The seat S is then caused to complete its pivotal movement about the horizontal axis Q (through approximately or exactly 180°) so that it constitutes the seat of the thus obtained easy chair. FIG. 12 shows the easy chair including the parts of FIG. 11 in a front elevational view; it will be noted that the pivot axis Q is located at the right-hand side of the back support 5 because such pivot axis is located at the left-hand side of the back support 5 when the parts of FIGS. 11 and 12 constitute an upright chair.

The pieces of furniture which are shown in FIGS. 7–12 exhibit the advantage that they comprise very simple frames, i.e., the frame members 7 can constitute the frames.

As shown in FIG. 12, the seat S can resemble a shallow trough, at least when the piece of furniture constitutes an easy chair. The same applies for the seats S' of the structures which are shown in FIGS. 1 to 9.

An important advantage of the improved piece of furniture is its simplicity in spite of the aforedescribed pronounced versatility and ready convertibility. The piece of furniture is inexpensive and compact, and it can be readily designed in such a way that it closely conforms to the outline of the body which occupies the upright chair or the easy chair. A person occupying an upright or plain chair is more comfortable if the seat is disposed at a reasonably large distance from the floor and if the back support is upright or nearly upright. The situation is different if the piece of furniture is converted into an easy chair, i.e., the seat is or should be nearer to the floor or to the ground and the inclination of the back support should be more pronounced. Moreover, arm rests are or can be in the way when the piece of furniture is used as an upright chair; on the other hand, the provision of arm rests is desirable and advantageous when the piece of furniture is used as an easy chair. The arm rests can further serve as depositories for ash trays, pieces of food, suntan lotions and/or other items which are expected to be used by the occupant of an easy chair.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A convertible piece of furniture for use as a first or different second seating facility, particularly as an upright chair or an easy chair, comprising a frame including first and second lateral frame members arranged to rest on a predetermined surface, such as the surface of a floor; a back support disposed between said frame members and having first and second sides and first and second lateral portions; and hinge means articulately connecting said frame members to the respective lateral portions of said back support for movement with reference to said back support through angles in excess of 90° between first positions in which the lateral frame members are located at one side of the back support and the piece of furniture constitutes the first seating facility to be occupied at said one side of the back support, and second positions in which the lateral frame members are located at the other side of the back support and the piece of furniture constitutes the second seating facility to be occupied at said other side of the back support.

2. The piece of furniture according to claim 1, wherein said back support makes with the predetermined plane a first angle in the first positions of said frame members and a different second angle in the second positions of said frame members.

3. The piece of furniture according to claim 1, wherein each of said angles equals or approximates 180°.

4. The piece of furniture according to claim 1, wherein said frame further comprises a seat.

5. The piece of furniture according to claim 4, wherein said seat comprises first and second portions which are integral with the respective frame members and together constitute a composite seat at least in the first positions of said frame members.

6. The piece of furniture according to claim 5, wherein said first and second portions of said seat constitute two arm rests in the second positions of said frame members.

7. The piece of furniture according to claim 1, wherein said hinge means have axes which are inclined with reference to the predetermined surface in at least one position of each of said frame members while the frame members rest on such surface.

8. The piece of furniture according to claim 1, wherein each of said frame members is substantially C-shaped.

9. The piece of furniture according to claim 1, wherein each of said frame members has a lower portion which contacts the predetermined surface in each position of the respective frame member and an upper portion which forms part of a seat in the first position of the respective frame member and constitutes an arm rest in the second position of the respective frame member.

10. The piece of furniture according to claim 1, wherein said frame further comprises a third frame member rigid with said back support and constituting a seat in the second positions of said frame members.

11. The piece of furniture according to claim 1, wherein said frame members include portions which together form a seat in the first positions of said frame members, and further comprising means for releasably coupling said portions of said frame members to each other in the first positions of said frame members.

12. The piece of furniture according to claim 1, wherein said frame consists of said frame members.

13. The piece of furniture according to claim 1, wherein said frame further comprises a substantially trough-shaped seat in at least one of said first and second positions of said frame members.

14. The piece of furniture according to claim 1, further comprising flexible upholstering means on said frame and on said back support.

15. The piece of furniture according to claim 1, wherein each of said frame members includes a first portion in a first plane and a second portion in a second plane disposed substantially at right angles to said first plane.

16. The piece of furniture according to claim 1, wherein at least one of said frame members consists of tubular stock.

17. A convertible piece of furniture for use as a first or a different second seating facility, particularly as an upright chair or an easy chair, comprising a frame consisting of first and second lateral frame members arranged to rest on a predetermined surface, such as the surface of a floor; a back support disposed between said frame members and having first and second lateral portions; hinge means articulately connecting said frame members to the respective lateral portions of said back support for movement with reference to said back support through angles in excess of 90° between first positions in which the piece of furniture constitutes the first seating facility and second positions in which the piece of furniture constitutes the second seating facility; a seat; and means for pivotally connecting said seat to said back support for movement between a first position behind said back support in the first positions of said frame members and a second position in which the seat is substantially horizontal and is disposed between said frame members in the second positions of said frame members.

18. The piece of furniture according to claim 17, wherein said connecting means defines a substantially horizontal pivot axis for said seat.

19. The piece of furniture according to claim 17, further comprising means for releasably coupling said seat to said frame members in the second positions of said seat and said frame members.

20. The piece of furniture according to claim 19, wherein said coupling means comprises plate-like members on said frame members and male coupling elements provided on said seat and arranged to enter openings provided therefor in said plate-like members.

21. A convertible piece of furniture for use as a first or a different second seating facility, particularly as an upright chair or as an easy chair, comprising a frame including first and second lateral frame members arranged to rest on a predetermined surface, such as the surface of a floor; a back support having a front side and a rear side, disposed between said frame members and having first and second lateral portions; hinge means articularly connecting said frame members to the respective lateral portions of said back support for movement with reference to said back support through angles in excess of 90° between first positions in which the piece of furniture constitutes the first seating facility and second positions in which the piece of furniture constitutes the second seating facility; a seat; and means for connecting said seat to one of said frame members for pivotal movement about a substantially horizonal axis which is substantially parallel to the front side of said back support between first and second positions in one of which said seat is substantially horizontal and is disposed between said frame members at the front side of said back support in the first positions of said frame members and in the other of which the seat is adjacent the rear side of said back support and is disposed between said frame members in the second positions of said frame members.

22. A convertible piece of furniture for use as a first or a different second seating facility, particularly as an upright chair or as an easy chair, comprising a frame including first and second lateral frame members arranged to rest on a predetermined surface, such as the surface of a floor; a back support having a front side and a rear side, disposed between said frame members and having first and second lateral portions; hinge means articulately connecting said frame members to the respective lateral portions of said back support for movement with reference to said back support through angles in excess of 90° between first positions in which the piece of furniture constitutes the first seating facility and second positions in which the piece of furniture constitutes the second seating facility; a seat; and means for connecting said seat to one of said frame members for pivotal movement about a substantially horizontal axis which extends substantially at right angles to the front side of said back support between first and second positions in one of which said seat is substantially horizontal and is disposed between said frame members at the front side of said back support in the first positions of said frame members and in the other of which the seat is adjacent the rear side of the back support between said frame members in the second positions of said frame members.

* * * * *